US005367923A

United States Patent [19]

Fabbro

[11] Patent Number: 5,367,923

[45] Date of Patent: Nov. 29, 1994

[54] CORKSCREW THAT EXTRACTS SIMULTANEOUSLY WITH THE CORK A PREVENTIVELY CUT PORTION OF THE CAPSULE ON THE NECK OF THE BOTTLE

[76] Inventor: Alberto Fabbro, Via Udine, 38,, I-33010 Cassacco, Italy

[21] Appl. No.: 30,106

[22] PCT Filed: Sep. 10, 1991

[86] PCT No.: PCT/IT91/00074

§ 371 Date: Mar. 9, 1993

§ 102(e) Date: Mar. 9, 1993

[87] PCT Pub. No.: WO92/04273

PCT Pub. Date: Mar. 19, 1992

[30] Foreign Application Priority Data

Sep. 11, 1990 [IT] Italy ..... 83472 A/90

[51] Int. Cl.[5] ..... B67B 7/44

[52] U.S. Cl. ..... 81/3.09; 81/3.45; 30/1.5

[58] Field of Search ..... 81/3.45, 3.33, 3.29, 81/3.36, 3.37, 3.09, 3.07; 30/1.5

[56] References Cited

FOREIGN PATENT DOCUMENTS 2340898 9/1977 France .
0059259 4/1891 Germany .
8913678 1/1990 Germany .
3927261 2/1991 Germany .
0019632 of 1904 United Kingdom ..... 30/1.5

*Primary Examiner*—Roscoe V. Parker
*Attorney, Agent, or Firm*—Harrison & Egbert

[57] ABSTRACT

A corkscrew for simultaneously cutting a capsule on a neck of the bottle and removing a cork from the bottle including a screw handle having a screw at one end for engaging the cork, a pair of force lever arms for the extraction of the cork after the screw engages the cork, a covering for sliding on the neck of the bottle such that the screw handle is in alignment with the cork, a cutter positioned within the covering, and an engagement member affixed to the screw handle and interactive with the cutter so as to cause the cutter to rotate during a rotation of the screw handle. The screw handle has gear teeth positioned in generally coaxial alignment with the screw. The force lever arms engage the gear teeth of the screw handle. The screw handle is rotatable relative to the covering. The covering includes a portion having a generally conical configuration. The cutter is affixed to an interior support member interconnected to the force lever arms. The cutter includes freely rotatable wheels. The engagement member is an arm which extends eccentrically downwardly from a handle of the screw handle.

6 Claims, 1 Drawing Sheet

CORKSCREW THAT EXTRACTS SIMULTANEOUSLY WITH THE CORK A PREVENTIVELY CUT PORTION OF THE CAPSULE ON THE NECK OF THE BOTTLE

TECHNICAL FIELD

The present invention relates to a corkscrew that extracts a cut portion of the capsule on the neck of the bottle simultaneously with the cork. Additionally, the present invention relates to devices for removing corks covered with a capsule.

BACKGROUND ART

It is well known in the prior art to provide corkscrews and also devices that cut the capsules which cover the cork. In particular, certain corkscrews utilize an extraction screw which screws axially into the cork and includes a means for axial removal of the cork.

There are also devices that cut the upper portion of the capsule so as to allow the capsule to be removed with the cork. Such devices are shown in U.S. Pat. No. 786,892 and European Patent No. 0220850. These devices, if integrated into a single device (as shown in German Patent No. 839,319 and French Patent No. 8200828), can operate only by means of two separate extraction operations. It is first necessary to cut and remove the upper portion of the capsule. After that operation, the cork can then be extracted. In fact, these devices have, at one end, the screw for the extraction of the cork and, at the other end, the means to cut and extract the capsule.

German Patent No. 8913678 discloses a cutting device that utilizes a conical cup that includes elastic fins. These elastic fins have, at their extremity, a cutting means which can cut the upper portion of the capsule that covers the upper extremity of the bottle. German Patent No. 3927261 discloses a corkscrew having an elastic guide cup. The guide cup has, at its extremity, a cutting means for cutting the upper portion of the capsule that covers the upper extremity of the bottle. The cutting means is activated by pressing downwardly and by rotating the complete corkscrew. Each of these devices has the disadvantage of having separate functions which occur before the use of the corkscrew. They have the disadvantage of requiring the rotation of the entire device for the purpose of cutting the upper portion of the capsule that covers the upper extremity of the body. German Patent No. 3927261 requires that the operator clasp, with one hand, the fins of the corkscrew and, with the other hand, rotate the bottle. After that, the operator can operate the screw handle for the extraction of the cork. In German Patent No. 8913678, it is not easy to rotate the cutting device because of the required downward pressure. The operator is required to press the cutting means with one hand and to rotate the bottle with the other hand.

It is an object of the present invention to conveniently remove the upper portion of the capsule which covers the upper extremity of the bottle while simultaneously allowing for the removal of the cork.

These and other objects and advantages of the present invention will become apparent from a reading of the attached specification and appended claims.

SUMMARY OF THE INVENTION

The present invention is a corkscrew for simultaneously cutting a capsule on a neck of a bottle and removing a cork from the bottle which comprises a screw handle means having a screw at one end for engaging the cork and having gear teeth positioned in generally coaxial alignment with the screw, a pair of force lever means for the extraction of the cork after the screw engages the cork, a covering means for sliding on the neck of the bottle such that the screw handle means is in alignment with the cork, a cutting means positioned within the covering means for engaging the neck of the bottle when the covering means slides downwardly along the neck of the bottle, and an engagement means affixed to the screw handle means and interactive with the cutting means so as to cause the cutting means to rotate during a rotation of the screw handle means. The force lever means engage the gear teeth on the screw handle means. The screw handle means is rotatable relative to the covering means. The covering means has a portion having a generally conical configuration. The cutting means serves to cut through a portion of the capsule. The force lever means serve to pull the cork through the cut portion of the capsule.

The cutting means is affixed to an interior support member positioned within the covering means. The interior support member is interconnected to the force lever means. The cutting means include freely rotatable wheels. The interior support member is an elastic fin extending downwardly from the force lever means. The covering means is a body having an elastomeric downward extension having a surface extending inwardly toward the neck of the bottle. The engagement means has an arm extending eccentrically downwardly from the handle of the screw handle means.

The present invention obtains the advantage of cutting the capsule and extracting the cork in only one operation. Upon removal of the cork, the cut capsule portion will rest directly on the extracted cork.

DETAILED DESCRIPTION OF THE INVENTION

Figure 1:
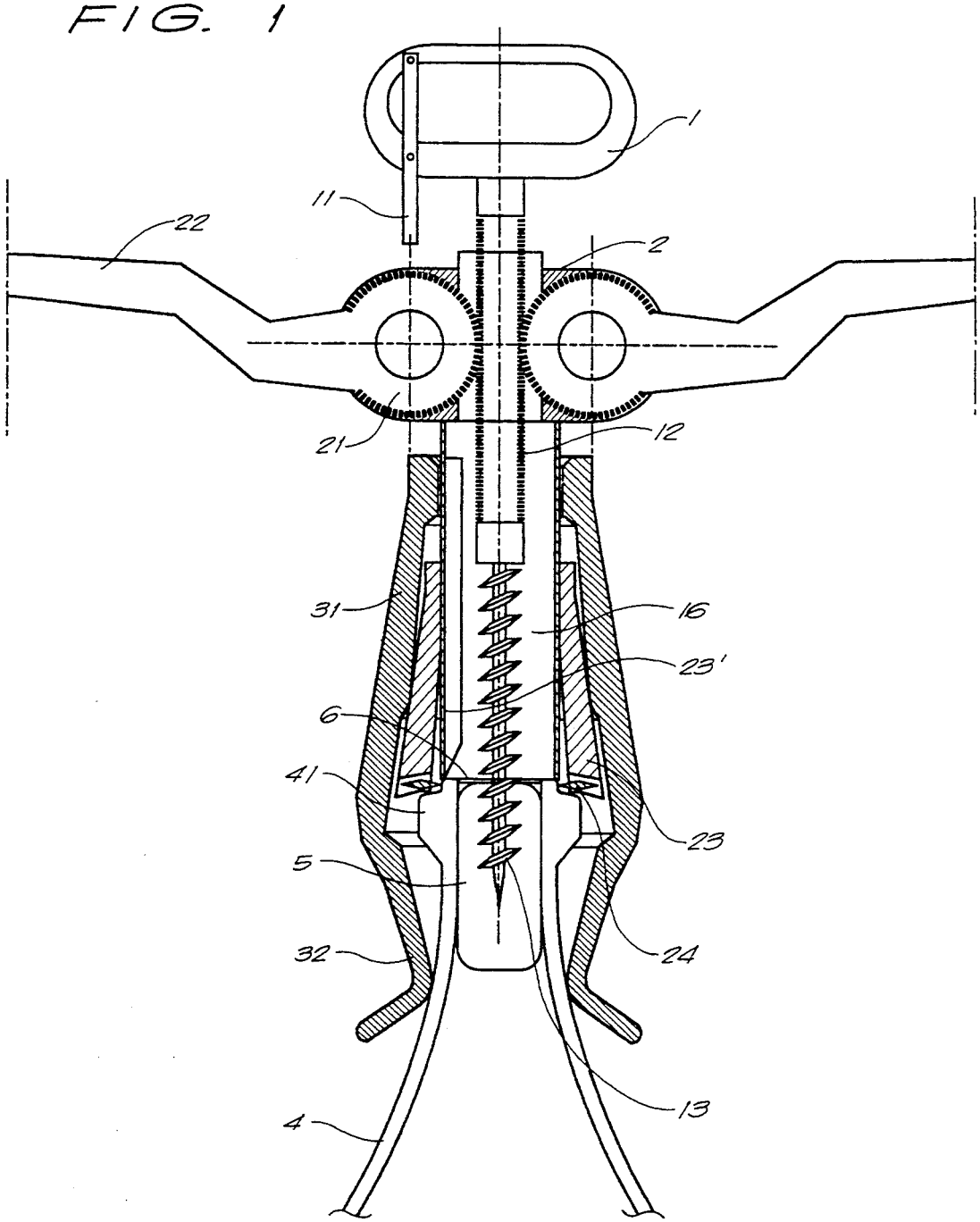
FIG. 1 represents a cross-sectional view of the corkscrew in accordance with the preferred embodiment of the present invention.

With reference to FIG. 1, the corkscrew of the present invention is a corkscrew having a generally standard exterior configuration. A screw handle means 1 supports a toothed gear portion 12 along its axial length. A screw 13 is positioned at one end of the screw handle means. The screw 13 serves to enter the cork 5 in the neck of a bottle 4 covered by a capsule 6. The screw handle 1 is moved axially by a pair of force levers 22. The force levers 22 includes teeth that engage the gear teeth 21 on a compass guide portion 2 and extends outwardly of the screw handle means 1. The screw handle means 1 will extend interiorly of the compass guide 2. A tube 23' is connected to the compass guide 2. The tube 23 extends downwardly so as to rest on the top of the bottle neck. This serves as a guide for the cork 6. An elastic finned element having free elastic fins 23 extends downwardly so as to support the rotating cutting wheels 24 thereon. These fins 23 are supported by the tube 23'. A sliding covering 31 has a generally conical configuration. This covering 31 supports two lower elastomeric guide arms 32. The guide arms 32 serve to push the elastic fins 23 toward the interior of the covering 31. This causes the cutting wheels 24 to be drawn into contact against the capsule 6 of the bottle 4. In this position, the cutting wheels 24 are in a proper position for cutting the covering of the capsule. The cutting wheels 24 will effect an annular cutting of the capsule. The covering 31 is designed so as to slide over the top of the bottle 4. The guide arms 32 extend inwardly of the open conical end of the covering 31. The covering 31 allows the elastic fins 23 to rotate freely therewithin. As such, the fins 23 are free to rotate on the interior of the covering 31. When this rotation occurs, the cutting wheels 24 serve to cut the top of the capsule. The covering 31 is designed so as to properly center the screw handle means in alignment with the cork 5. Although the elastic fins 23 are freely rotatable within the interior of the covering 31, they are also positioned in general alignment with the cork 5 through the operation of the covering 31.

The rotation of the elastic fins 23 occurs simultaneously with the rotation of the screw handle means 1. An eccentric arm 11 is affixed to the handle of the screw handle means 1. When the screw 13 is almost completely screwed into the cork 5, the arm 11 will come into abutment with the compass guide 2. The abutment of the arm 11 with the compass guide 2 causes the compass guide 2, and its associated force lever arms to rotate with the rotation of the handle. This causes a simultaneous rotation of the interior support tube 23' and the elastic fins 23. This rotation causes the cutting wheels 24 to rotate so as to cut the capsule portion 6.

I claim:

1. A corkscrew for simultaneously cutting a capsule on a neck of a bottle and removing a cork from the bottle comprising:

a screw handle means having a screw at one end for engaging the cork, said screw handle means having gear teeth positioned in generally coaxial alignment with the screw;

a pair of force lever means for the extraction of the cork after the screw engages to cork, said pair of force levers means engaging the gear teeth of said screw handle means;

a covering means for sliding on the neck of the bottle such that said screw handle means is in alignment with the cork, said screw handle means being rotatable relative to said covering means, said covering means having a portion having a generally conical configuration;

a cutting means positioned within said covering means, said cutting means engaging the neck of the bottle when said covering means slides downwardly along the neck of the bottle; and an engagement means affixed to said screw handle means, said engagement means being interactive with said cutting means so as to cause said cutting means to rotate during a rotation of said screw handle means, said cutting means for cutting through a portion of the capsule, said pair of force lever means for pulling the cork through the cut portion of the capsule.

2. The corkscrew of claim 1, said cutting means being affixed to an interior support member, said interior support member interconnected to said force lever means.

3. The corkscrew of claim 1, said cutting means being freely rotatable wheels.

4. The corkscrew of claim 2, said interior support member being an elastic fin extending downwardly from said force lever means.

5. The corkscrew of claim 1, said covering means being a body having an elastomeric downward extension with a surface extending inwardly toward the neck of the bottle.

6. The corkscrew of claim 1, said engagement means being an arm extending eccentrically downwardly from a handle of said screw handle means.

* * * * *